US008201373B2

(12) United States Patent
Charles, Jr.

(10) Patent No.: US 8,201,373 B2
(45) Date of Patent: Jun. 19, 2012

(54) LINER FOR CONCRETE FORMS

(76) Inventor: Kenneth L. Charles, Jr., Columbia, PA (US)

( * ) Notice: Subject to any disclaimer, the term of this patent is extended or adjusted under 35 U.S.C. 154(b) by 284 days.

(21) Appl. No.: 12/654,118

(22) Filed: Dec. 10, 2009

(65) Prior Publication Data

US 2011/0056165 A1 Mar. 10, 2011

Related U.S. Application Data

(60) Provisional application No. 61/276,185, filed on Sep. 9, 2009.

(51) Int. Cl.
*B44F 7/00* (2006.01)
*E04B 5/04* (2006.01)

(52) U.S. Cl. ..... 52/314; 52/605; 249/214

(58) Field of Classification Search ..... 52/309.17, 52/314, 555, 316, 605, 311.1, 742.14, 745.19; 249/15, 16, 189, 190, 214
See application file for complete search history.

(56) References Cited

U.S. PATENT DOCUMENTS

| | | | | |
|---|---|---|---|---|
| 1,552,711 | A | 9/1925 | Lane | |
| 2,465,871 | A | 3/1949 | Hardie et al. | |
| 2,825,221 | A | 3/1958 | Brouk | |
| 3,307,822 | A * | 3/1967 | Stout | 249/189 |
| 3,594,968 | A | 7/1971 | Johnson | |
| 3,602,476 | A | 8/1971 | Iragorri | |
| 4,031,682 | A | 6/1977 | Renkert | |
| 4,644,719 | A | 2/1987 | Salazar | |
| 4,773,201 | A * | 9/1988 | Trezza | 52/510 |
| 5,002,817 | A | 3/1991 | Jones | |
| 5,225,134 | A | 7/1993 | Nasvik et al. | |
| 5,268,137 | A | 12/1993 | Scott et al. | |
| 5,487,526 | A * | 1/1996 | Hupp | 249/2 |
| 5,502,941 | A * | 4/1996 | Zember et al. | 52/314 |
| 5,667,190 | A * | 9/1997 | Scott et al. | 249/16 |
| 5,824,347 | A | 10/1998 | Serafini | |
| 5,900,180 | A | 5/1999 | Scott et al. | |
| 6,164,037 | A | 12/2000 | Passeno | |
| 6,224,031 | B1 * | 5/2001 | Boeshart | 249/214 |
| 6,529,664 | B1 * | 3/2003 | Deason | 385/115 |
| 6,634,617 | B2 | 10/2003 | Potvin | |
| 6,808,667 | B2 | 10/2004 | Nasvik et al. | |
| 7,238,406 | B2 | 7/2007 | Peterson | |
| 7,448,172 | B1 * | 11/2008 | Knodel | 52/98 |
| 2002/0100241 | A1 | 8/2002 | Rygiel | |
| 2005/0064128 | A1 | 3/2005 | Lane et al. | |
| 2006/0156668 | A1 * | 7/2006 | Nasvik | 52/516 |
| 2006/0157634 | A1 | 7/2006 | Nasvik | |
| 2006/0180731 | A1 | 8/2006 | Scott et al. | |
| 2009/0100774 | A1 | 4/2009 | Fasching et al. | |

* cited by examiner

*Primary Examiner* — William Gilbert
*Assistant Examiner* — Branon Painter
(74) *Attorney, Agent, or Firm* — Richard C. Litman

(57) ABSTRACT

The liner for concrete forms is a plastic matrix for simulating the mortar grooves conventionally formed in masonry construction. The liner is placed within a concrete form, and the concrete is poured thereover. The form is removed after the concrete sets, thereby exposing the surface with the liner still remaining therein. The surface of the concrete panel may then be treated as desired to produce a surface finish resembling brick or other masonry construction, e.g., sandblasted or coated with stucco or other material, with the liner remaining in place to protect the simulated mortar grooves. Once the surface of the concrete panel has been treated as desired, the liner is removed to expose the natural concrete surface within the grooves, with this natural concrete surface closely resembling the mortar joints in a masonry wall.

11 Claims, 9 Drawing Sheets

LINER FOR CONCRETE FORMS

CROSS-REFERENCE TO RELATED APPLICATION

This application claims the benefit of U.S. Provisional Patent Application Ser. No. 61/276,185, filed Sep. 9, 2009.

BACKGROUND OF THE INVENTION

1. Field of the Invention

The present invention relates generally to concrete construction, and particularly to a liner for concrete forms for use in casting concrete, the liner having a configuration simulating mortar joints in masonry construction or any other lattice or openwork pattern.

2. Description of the Related Art

Concrete is a commonly used construction material due to its relative economy, ease of construction, and strength. However, plain and unadorned concrete has never been considered to produce an attractive structure when completed. As a result, concrete is often used to construct the structural members of a building structure, with other materials (e.g., brick or stone, etc.) being used as an exterior surface or veneer for the concrete panels. While this technique produces a wall or panel having an appearance identical to a structure constructed entirely of brick or stone, this additional material and labor obviously results in a more costly structure.

As a result, various techniques have been developed for producing a prefabricated concrete panel having an attractive texture integrated with the concrete at the time the panel is cast. Most of these techniques incorporate actual pieces of a separate material (thin brick faces or complete bricks, natural or simulated stone, etc.) laid into the mold or form, with the concrete being poured thereover and partially embedding the separate material therein when set. In some cases, additional structure in the form of shallow wood stringers or the like is placed into the form between the separate brick or stone pieces. The stringers are removed after the concrete sets to produce a series of gaps in the surface resembling mortar joints between the embedded pieces. In other cases the mold or form itself includes a matrix of ridges therein, with the separate brick or stone pieces being set between the ridges. The brick or stone pieces remain embedded in the concrete when it cures, with the removal of the form leaving mortar-like grooves between the embedded pieces. It will be noted that all of the above techniques require the incorporation of separate pieces of brick or stone placed in the concrete form, before the concrete is poured. This results in much the same problem as noted further above, i.e., the additional expense due to the additional materials and labor required to produce the finished concrete panel.

Thus, a liner for concrete forms solving the aforementioned problems is desired.

SUMMARY OF THE INVENTION

The liner for concrete forms is a plastic matrix having a configuration simulating the mortar joints of a masonry (brick or stone) wall or other lattice or openwork pattern. The liner is open between each simulated joint line. The liner may have any of numerous configurations simulating different patterns of brickwork or stone masonry. The liner is placed within the bottom or floor of a concrete form, and temporarily attached thereto to prevent its being dislodged when the concrete is poured. The liner includes numerous small protrusions extending therefrom that are embedded in the concrete when it is poured. The concrete is removed from the form once it has set. The liner remains with the concrete due to the protrusions of the liner being embedded therein.

At this point, the surface of the concrete panel may be treated as desired. The surface may be sandblasted to produce a texture resembling bricks, stone, or other texture as desired, or to expose decorative aggregate previously added to the concrete. Alternatively, stucco or other finishing material may be applied to the surface of the panel to produce a simulated surface as desired, e.g., brick or other masonry surface of desired color. When the desired surface treatment has been completed, the liner is removed from the surface of the concrete panel to expose the simulated mortar joints. As these simulated joints were covered by the liner during the surface treatment process, they remain untreated and retain the appearance of the natural concrete, i.e., closely resembling a conventional mortar or grout joint.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The liner for concrete forms includes several embodiments of a liner forming grooved indentations in the concrete when the concrete is poured and set. The liner embodiments are patterned to produce a facsimile of the mortar or grout joints of a masonry wall. The concrete panel resembles such a masonry wall after setting or curing, and after further treatment or finishing of the concrete and subsequent removal of the liner.

Figure 1:
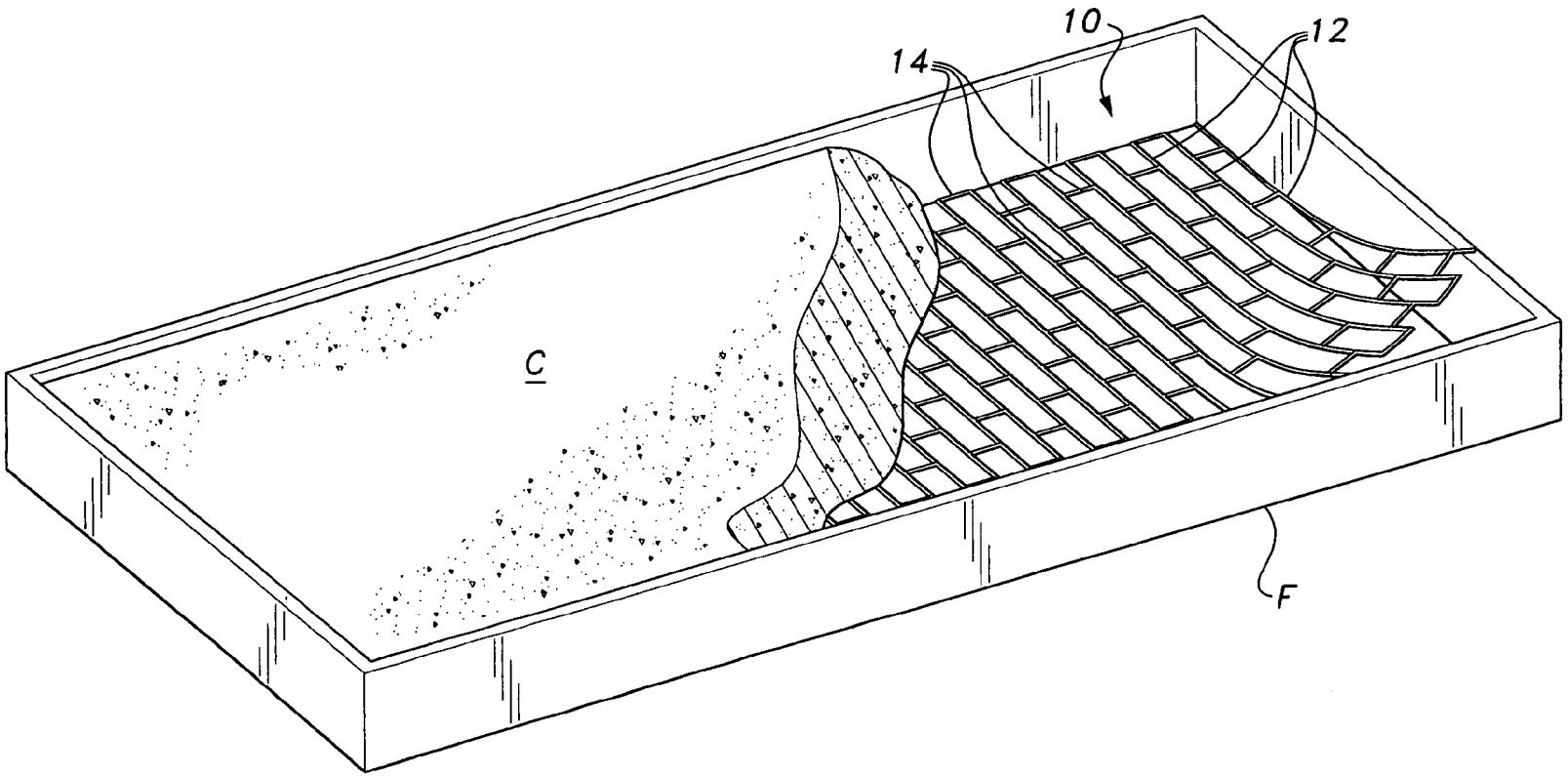
FIG. 1 is an environmental, perspective view of a concrete form having a liner for concrete forms according to the present invention installed therein, shown partially filled with fresh concrete.

FIG. 1 of the drawings is an illustration of an exemplary concrete pour with a first embodiment of the liner 10 installed within the form F, and a fresh pour of concrete C shown partially covering the liner 10. This drawing essentially illustrates the first few steps in a method of forming a simulated masonry panel using any of the embodiments of the liner, wherein the matrix or lattice-type liner is initially secured within the provided form and the fluid concrete is poured into the form, thereby encapsulating the matrix within the surface of the concrete adjacent to the floor or bottom of the form.

Each of the embodiments of the liner for concrete forms described herein comprises a plastic matrix or lattice of relatively thin and elongate liner elements, with each of the elements having the form of a mortar or grout line or joint between adjacent bricks, blocks, stones, etc., as found in a masonry structure or other openwork pattern. In the liner 10 shown in FIG. 1, a series of spaced apart and parallel first elements 12 for simulate the horizontal joints or grooves of a conventional stretcher bond brick masonry wall or structure, and another series of staggered, spaced apart and parallel second elements 14 simulate the vertical joints or grooves between the ends of the bricks in such a masonry structure. The areas between the various elements 12 and 14 remain open to allow the concrete C to flow therebetween. The spacing between the first elements 12 is preferably equal to the thickness of a conventional masonry brick. The spacing between the second elements is preferably equal to the length of such a brick. The elements 12 and 14 themselves each have a width equal to that of a conventional grout or mortar joint formed between bricks when constructing a wall or other structure of bricks.

Figure 2:
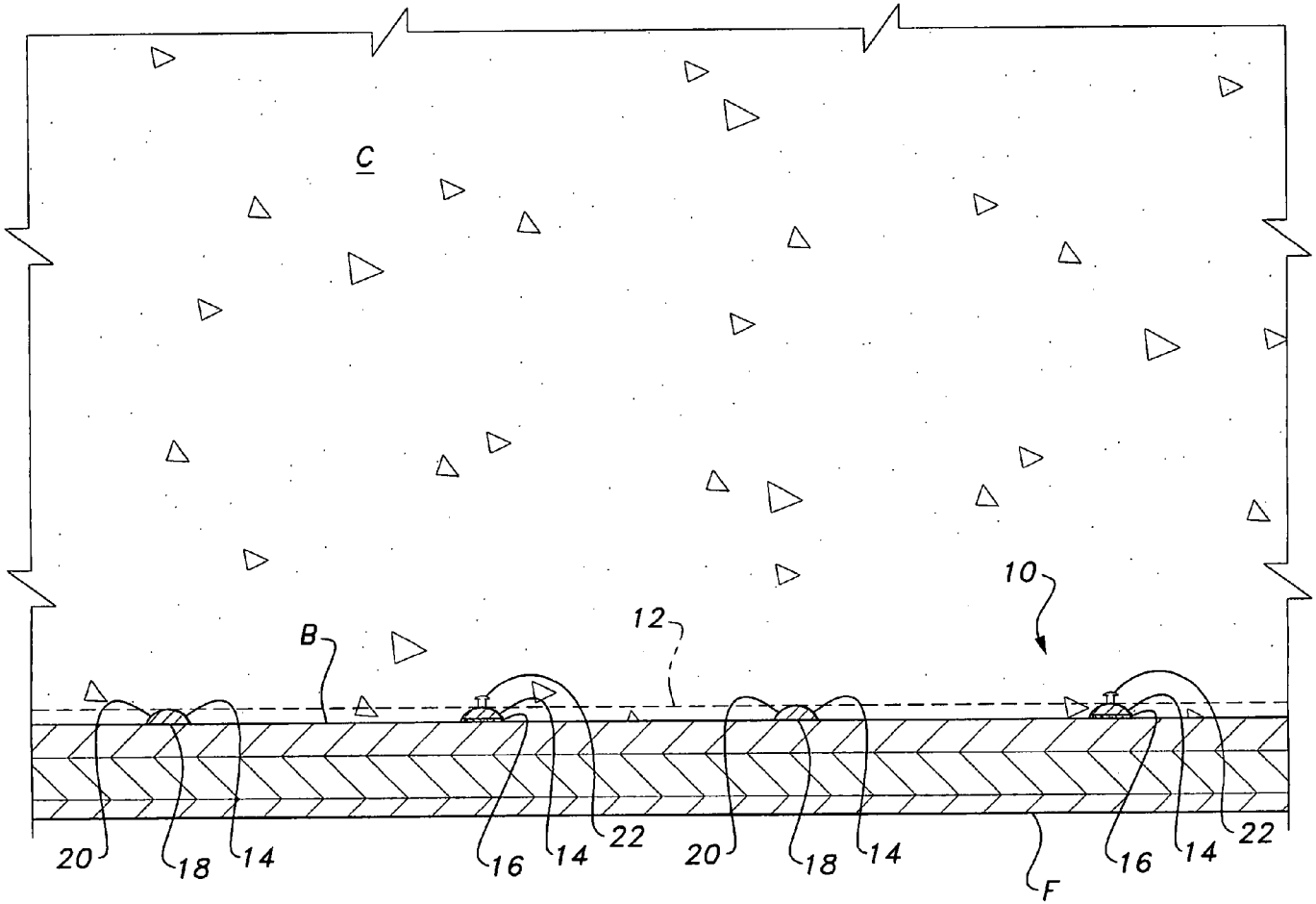
FIG. 2 is a detailed side elevation view in section through a concrete form having the liner of FIG. 1 and cast concrete therein, showing further details of the liner and its installation in the form.

FIG. 2 is a detailed side elevation view in section through the concrete form F of FIG. 1. The liner 10 is positioned on the inner surface of the bottom B or floor of the form F, and is preferably secured in place by double-stick tape strips 16 to prevent the liner 10 from being dislodged from its predetermined position within the form F by the concrete C as it is being poured. It is not necessary to apply the tape 16 continuously to all of the elements 12 and 14; the tape 16 is shown applied to only some of the elements 14, in the example of FIG. 2.

FIG. 2 also clearly shows an exemplary cross section for the vertical or header elements 14 of the liner 10. It will be understood that the cross-sections of the horizontal or stretcher elements 12 is preferably essentially identical, in any given embodiment of the liner. The outer surface 18 of each of the liner elements 12 and 14, i.e., the surface that will be exposed when the cured concrete is removed from the form, is preferably flat in order to conform to the flat bottom surface B of the concrete form F and to provide good contact area for the double-stick tape 16. However, the opposite embedding surface 20 preferably comprises a geometric shape of some sort, e.g., a semicircular cross section, to simulate the arcuate cross-sectional shape of a conventional mortar groove or joint in a masonry wall or structure. However, the liner may be made with elements of any desired cross section to simulate square or rectangular mortar grooves or other mortar groove cross-sectional shapes, as desired.

In addition to the double-sided tape 16 used to secure the liner 10 within the concrete form F, the liner 10 also provides means for positive attachment to the concrete structure once the concrete has set. This is achieved by a series of small tabs 22 extending from some of the first and/or second elements 12 and 14. Each of the tabs 22 preferably comprises a narrow stem on the order of 1/16 inch in diameter and about 1/16 inch high, with a small button or tab having a width of about 1/8 inch extending from its distal end. The fluid concrete flows around the matrix elements 12 and 14 and their tabs 22 when poured, encapsulating the elements 12 and 14 and their tabs 22 therein. The liner 10 is thus firmly attached to the concrete structure once the concrete sets. However, each of the tabs 22 includes perforations or other weakening between the base of the tab 22 and its element 12 or 14. When the liner 10 is pulled loose from the cured concrete panel after the panel has been finished, the stems and their widened button distal ends remain within the concrete while the remainder of the liner 10 is separated therefrom. The very small size of the stems of the tabs 22, on the order of 1/16 inch, result in the stems being extremely unobtrusive and invisible for all practical purposes once the liner 10 has been pulled loose from the cured concrete panel.

Figure 3:
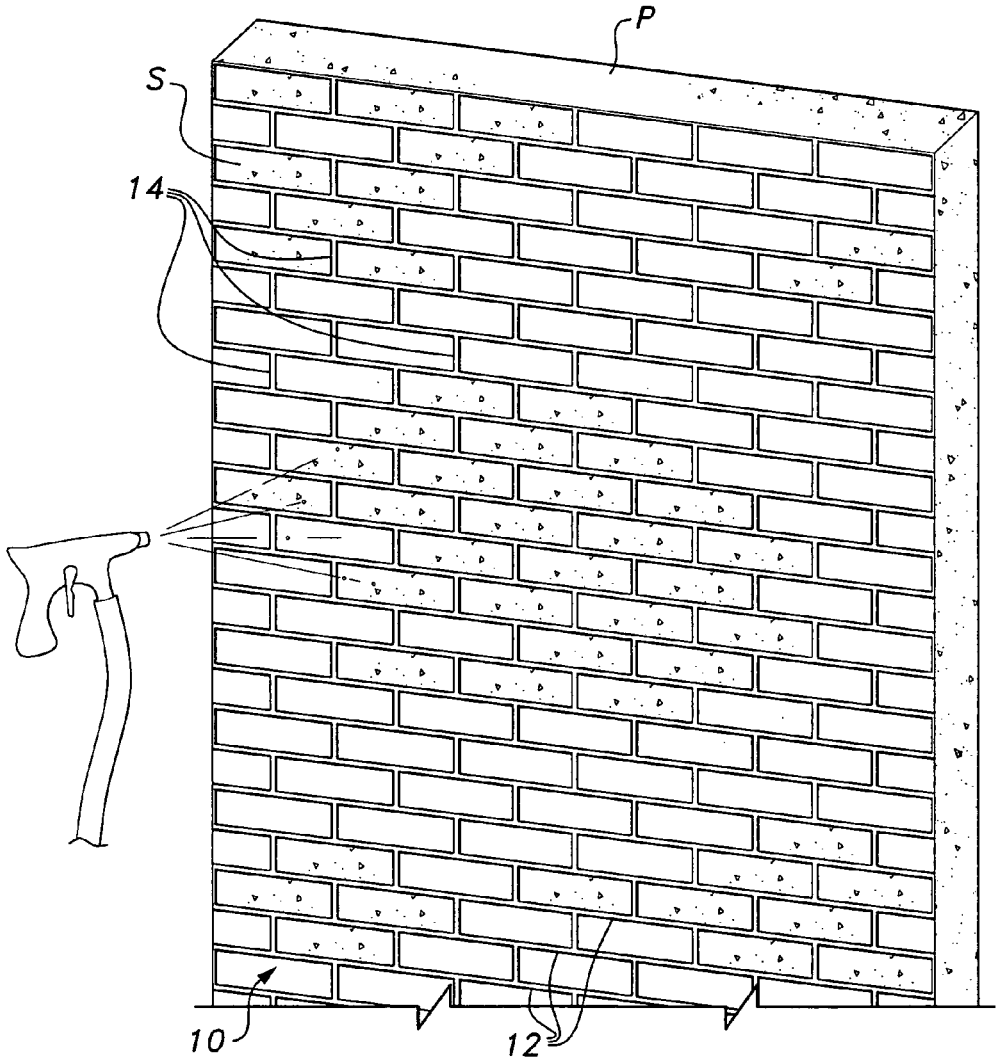
FIG. 3 is an environmental perspective view of a cured concrete panel having the liner of FIG. 1 still installed thereon, showing a finishing step.

FIG. 3 provides an illustration of an exemplary finishing step for a cured concrete panel P, with the liner 10 remaining embedded therein. In FIG. 3, the steps of curing the concrete and removing the mold or form from the cured concrete panel have already been completed, with these steps being essentially conventional. Once the cured concrete panel P has been removed from the mold or form F, the molded surface S of the concrete panel P, with the liner 10 still embedded therein, is exposed, generally as shown in FIG. 3. Thus, any treatment applied to the exposed surface S of the concrete panel P will not reach the grooves or simulated masonry joints in the panel P, as they are still covered by the liner 10.

This permits a relatively broad and continuous surface treatment to be applied to the surface S of the cured concrete panel P without concern for applying the treatment to the grooves or simulated joints of the panel as well. In FIG. 3, the treatment shown may comprise media (e.g., sand) blasting of the surface S using a media blaster or gun to roughen or otherwise texture the surface to a brick-like texture or to expose a decorative aggregate previously added to the concrete, or applying a stucco finish using a spray gun or the like. Other surface treatments may be used as desired, e.g., coloring the surface to the desired brick or other masonry color, so long as the liner 10 remains in place on the cured concrete panel P during the treatment process.

Figure 5:
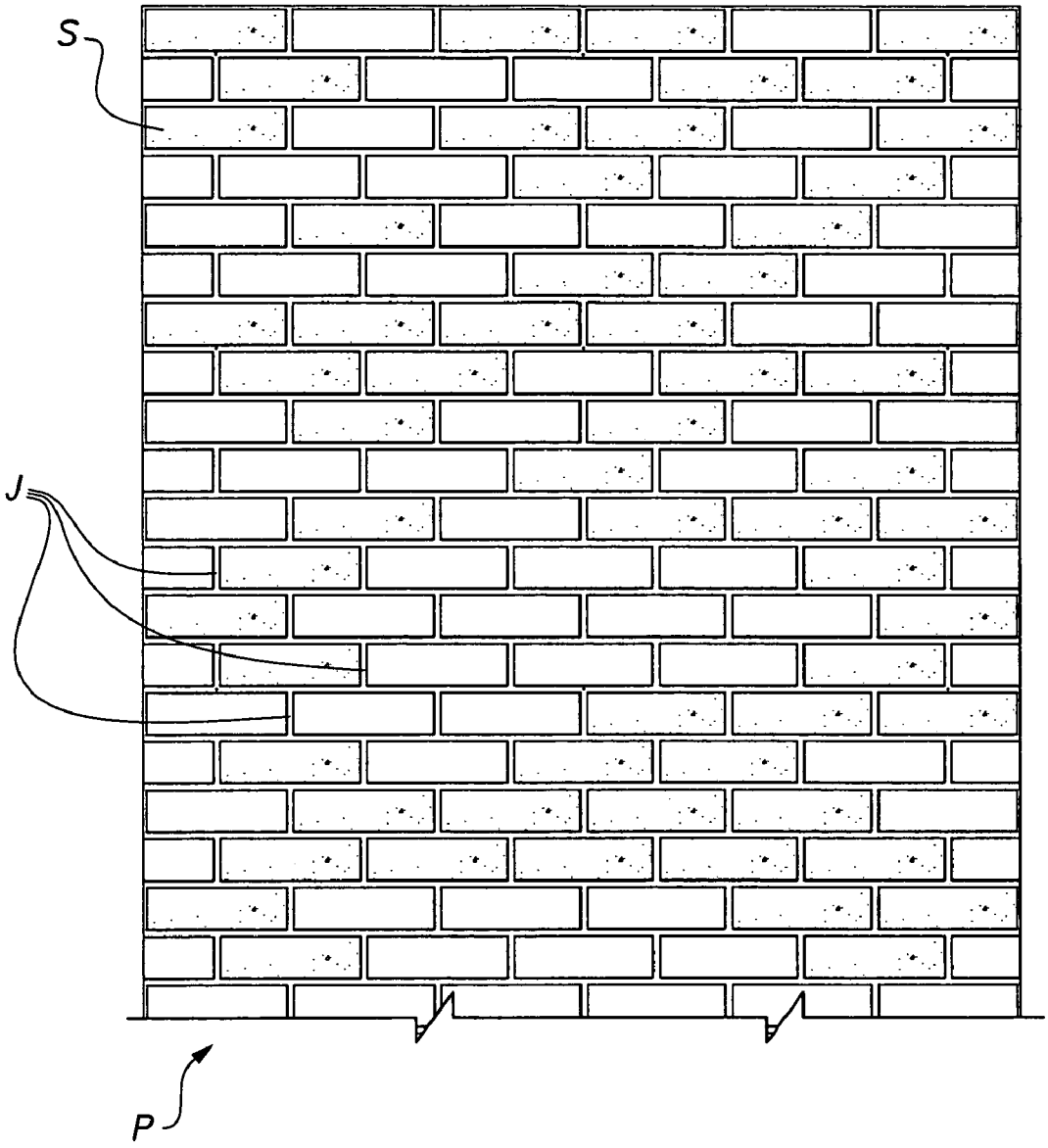
FIG. 5 is a front elevation view showing a cured concrete panel previously formed using the liner of FIG. 1, with the liner removed to show the pattern of the concrete surface.

FIG. 5 is an elevation view of a completed concrete panel P after surface treatment and removal of the liner matrix from the exposed surface S thereof. The surface S has been treated or textured as described above, while the liner matrix remained embedded in the surface S of the cured concrete panel P. In FIG. 5 the liner matrix has been removed after treatment of the surface S, leaving the simulated mortar or grout joints J exposed. The end result is a very realistic simulation of a masonry wall or other structure, without requiring the addition of a brick or other masonry veneer over the concrete panel. It will be seen that the pattern of simulated masonry joints shown in the example of FIG. 5 is of a stretcher bond brick wall configuration, as would be formed by the liner 10 illustrated in FIGS. 1 and 3 and described further above.

Figure 4:
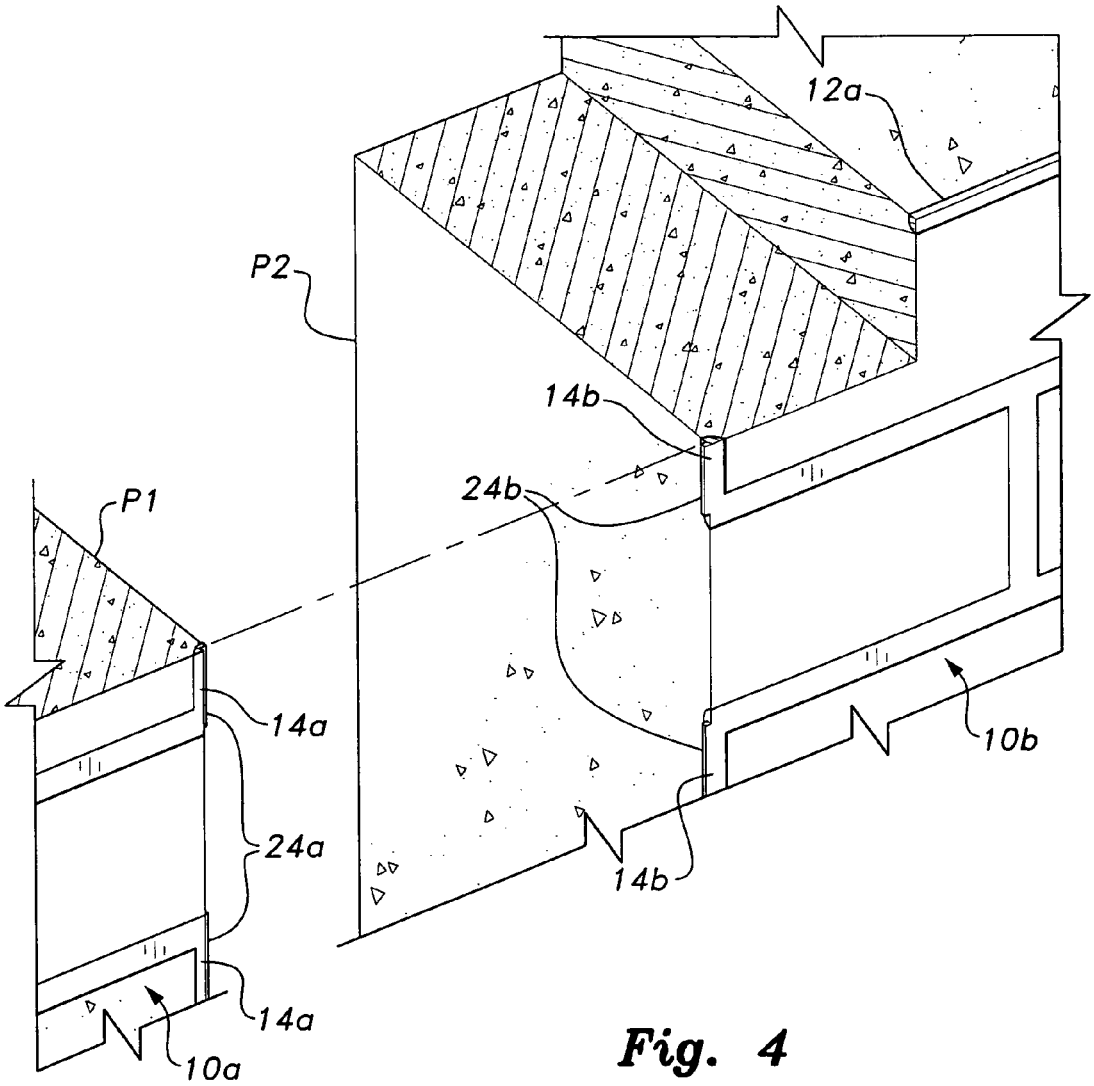
FIG. 4 is a detailed perspective view showing various alternative embodiments of a liner for concrete forms according to the present invention.

The liner for concrete forms may be modified or configured to permit two or more cured concrete panels to be joined with one another to form a simulation of a continuous masonry wall, if so desired. FIG. 4 provides an illustration of two concrete panels P1 and P2 with their respective liner matrices 10*a* and 10*b* remaining embedded therein. A portion of the upper edge of the panel P2 is exposed in FIG. 4, with the corresponding horizontal or stretcher element 12*a* comprising a quarter round cross section. Thus, a mating concrete panel (not shown) placed atop the upper edge of the panel P2 and having a similar quarter round shape for the horizontal element extending along the lower edge thereof, would mate precisely with the quarter round element 12*a* to provide complete coverage of the entire width of the semicircular groove or joint formed by the two vertically assembled concrete panels.

Alternative complementary edge elements may be provided, as shown for the vertical or header elements 14*a* and 14*b* in FIG. 4. The vertical elements 14*a* of the concrete panel P1 include grooves 24*a* formed along their outer edges, while the vertical elements 14*b* of the panel P2 include complementary tongues or protrusions 24*b* formed along their outer edges. The mating tongues 24*b* and grooves 24*a* serve to connect the two partial elements 14*a* and 14*b* with one another, thus sealing the simulated vertical or header masonry joint created when the two cured concrete panels P1 and P2 are assembled laterally with one another.

Figure 6:
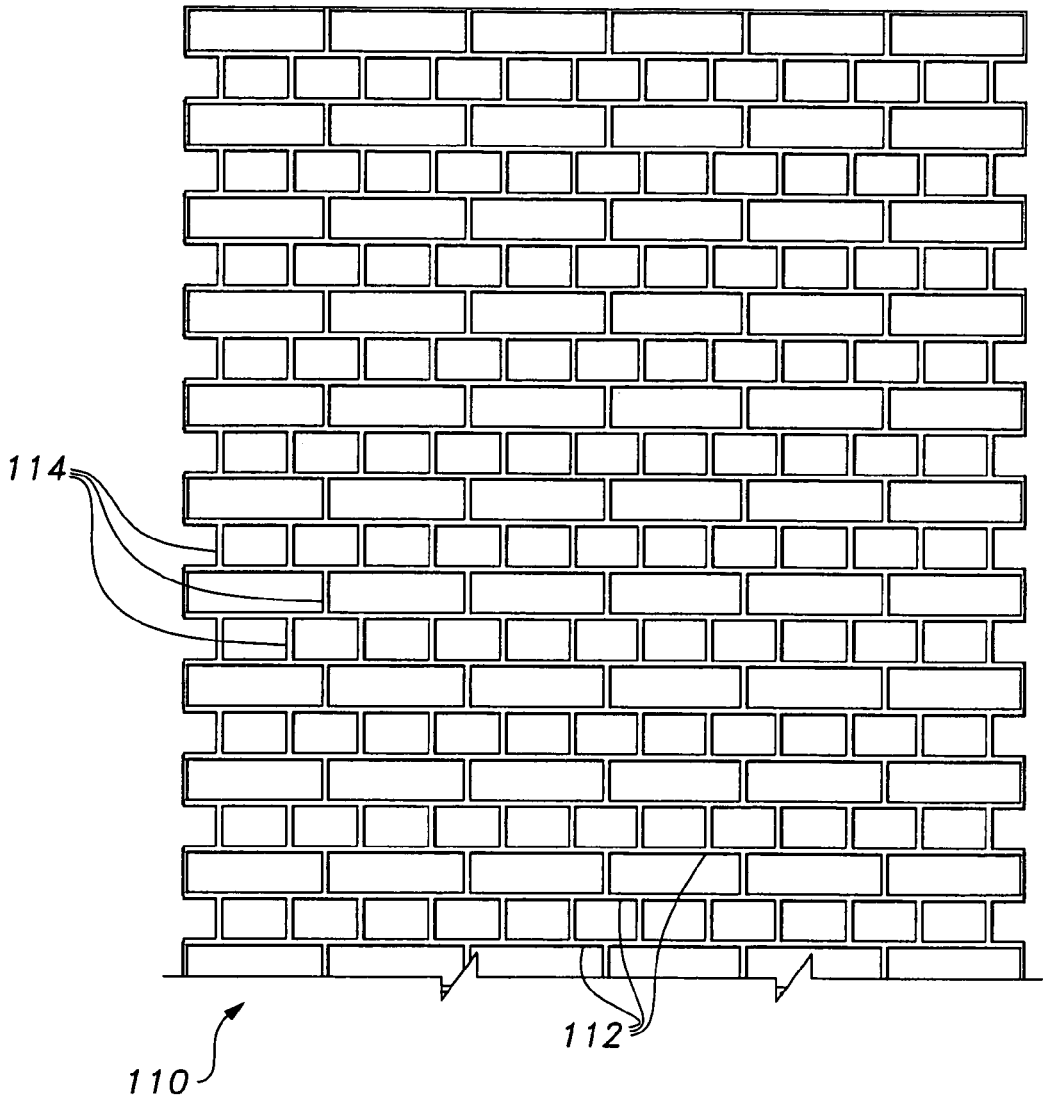
FIG. 6 is a plan view of an embodiment of a liner for concrete forms according to the present invention for use in forming an English bond brick pattern in the concrete.

FIGS. 6 through 9 illustrate exemplary configurations that may be provided by various embodiments of the liner for concrete forms. It should be noted that the liner embodiments of FIGS. 6 through 9 show only the liners, and do not illustrate any of the simulated brick or masonry structure that may be formed by or within the liners. In FIG. 6, the liner 110 is in the configuration of an English bond brickwork pattern, i.e., alternating stretcher courses are separated by continuous header courses. The header courses are separated by horizontal or stretcher elements 112, with vertical elements 114 extending between the horizontal stretcher elements 112.

Figure 7:
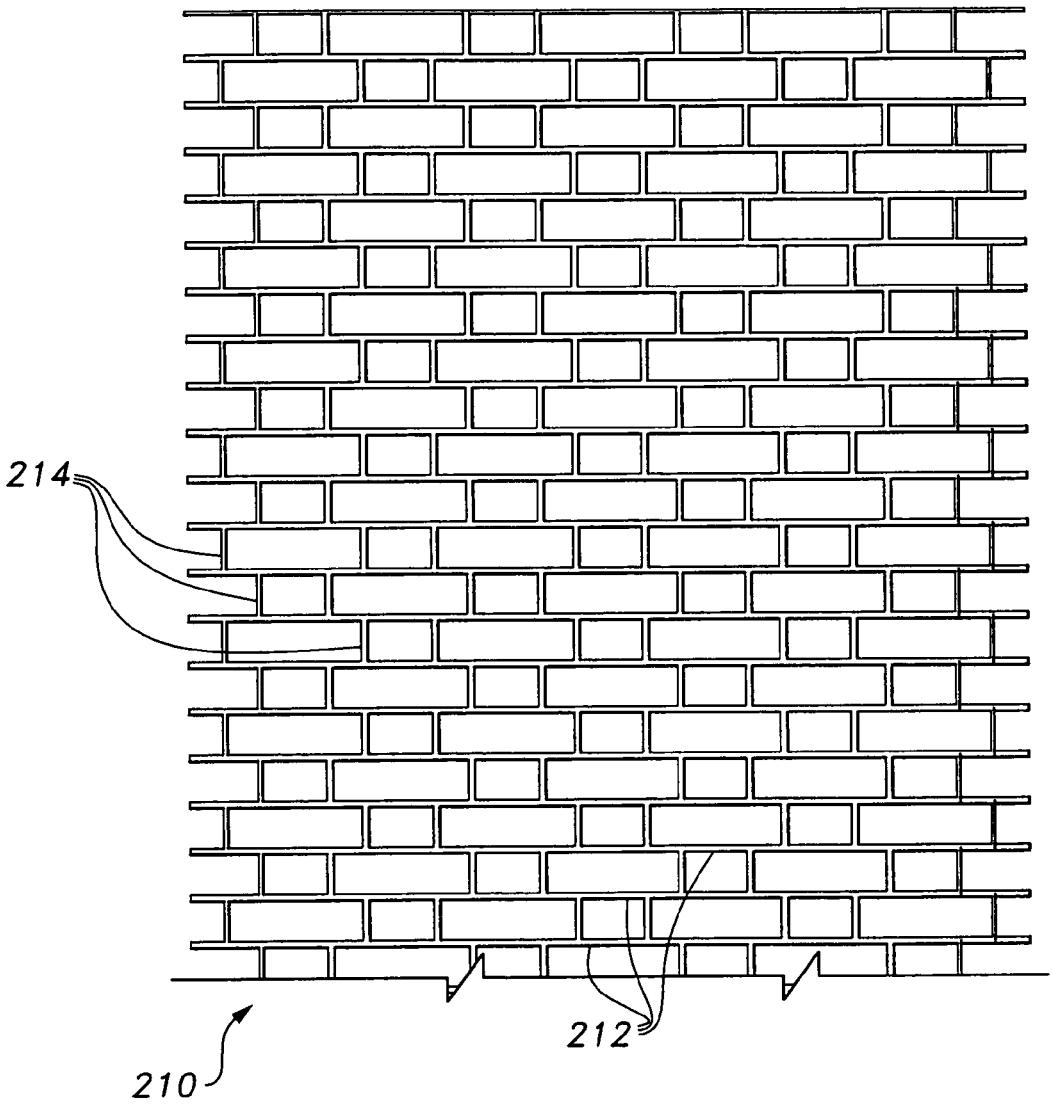
FIG. 7 is a plan view of an embodiment of a liner for concrete forms according to the present invention for use in forming a Flemish bond brick pattern in the concrete.

FIG. 7 is an illustration of a liner 210 for concrete forms, in which the liner is in the configuration of a Flemish bond brickwork pattern. The Flemish bond pattern comprises alternating stretcher and header (end) bricks in each course, with a header brick centered over each stretcher brick in the underlying course. Horizontal elements 212 and vertical elements 214 take a form as shown in FIG. 7, when simulating a Flemish bond pattern.

Figure 8:
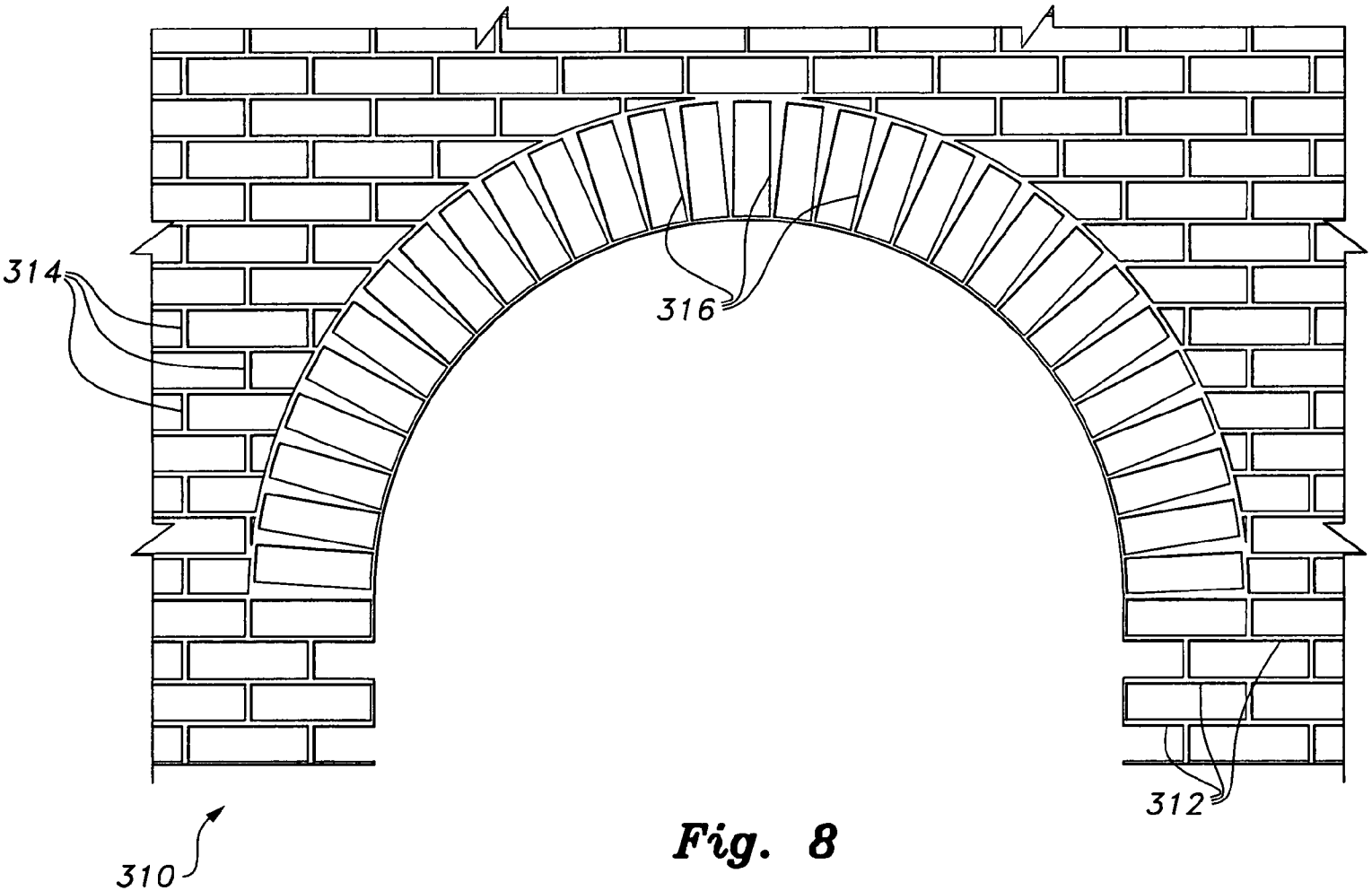
FIG. 8 is a plan view of an embodiment of a liner for concrete forms according to the present invention for use in forming an arch pattern in the concrete.

FIG. 8 illustrates a liner 310 for forming a simulated masonry arch. The outlying horizontal and vertical elements 312 and 314 simulate conventional stretcher brickwork courses, while the inner, radially disposed elements 316 simulate the joints between a semicircular arch of bricks. It will be noted that the radially disposed elements 316 of the arch are wider at their outer ends than at their inner ends, in order to simulate the constant thickness of bricks used to form such an arch.

Figure 9:
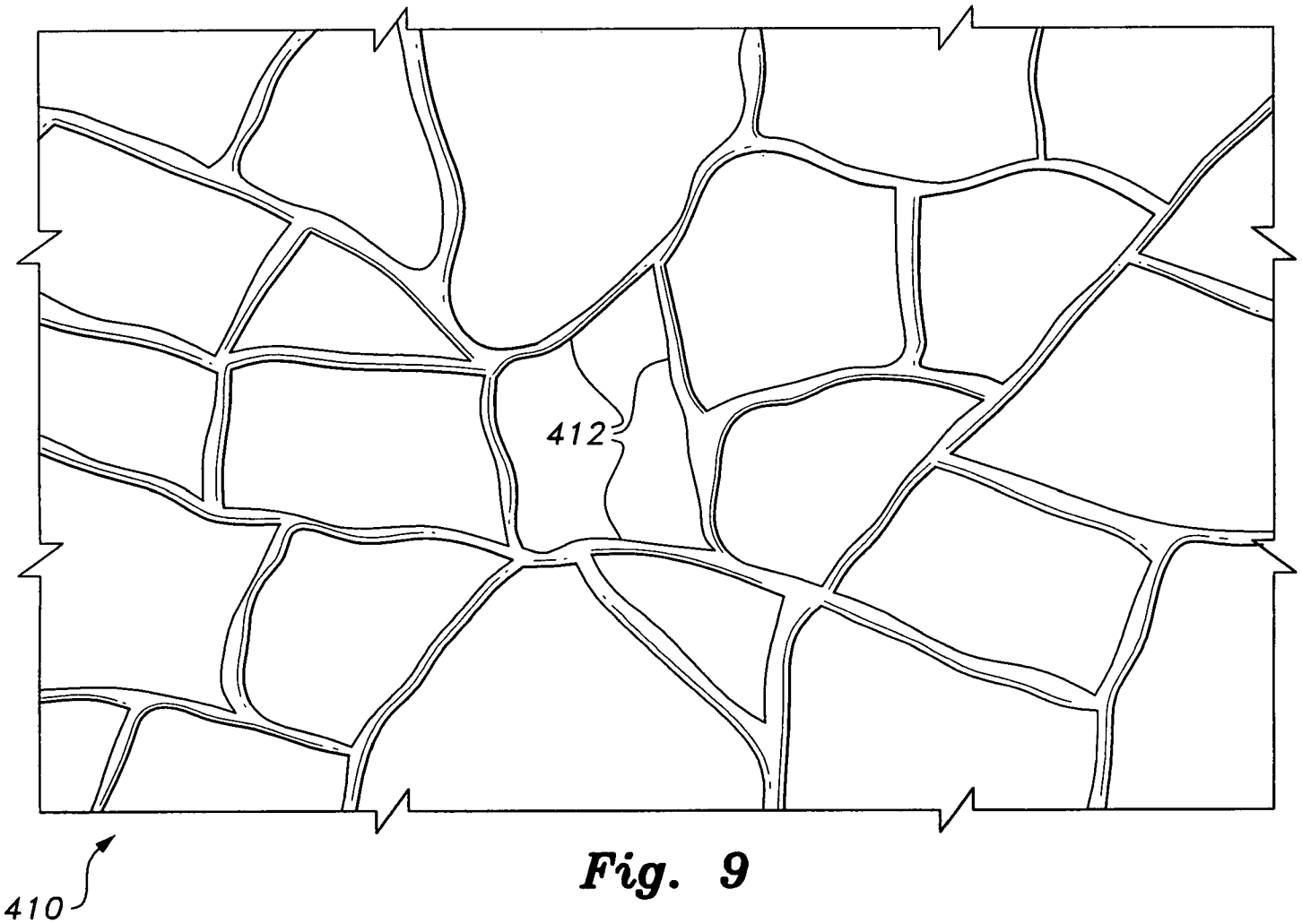
FIG. 9 is a plan view of an embodiment of a liner for concrete forms according to the present invention for use in forming a randomized stone pattern in the concrete.

FIG. 9 illustrates an exemplary liner configuration 410 for simulating a stone wall or other stonework formed of natural or shaped stones. The liner elements 412 are apparently randomly oriented, as would be the case if a masonry structure were formed of naturally shaped stones. It will also be noted that the simulated mortar or grout joints of the stonework liner 410 are not of uniform thickness but vary somewhat in thickness from one another, as would be the case when constructing a stonework wall or structure of natural, unevenly shaped stone.

Any of the above-described liner for concrete forms may be used as needed in accordance with the simulated masonry structure desired. The process or method of forming the simulated masonry wall or structure is the same with any of the above embodiments, i.e., laying the liner in the bottom of the form and trimming it to fit as required; anchoring the liner within the form to prevent its shifting or dislodging as the concrete is formed; pouring the concrete; allowing the concrete to cure or set; removing the cured concrete slab or panel from the mold with the liner remaining attached; finishing the exposed surface of the concrete slab or panel with the liner remaining in place in the slab to protect the simulated masonry joints from the treatment process; and finally, removing the liner to expose the simulated masonry joints of the panel. It should be further noted that the liner embodiments disclosed herein are exemplary, and that innumerable other liner embodiments simulating other brickwork bond patterns, brickwork or stonework structures of various configurations, or various patterns simulating natural or shaped stone may be developed as desired.

It is to be understood that the present invention is not limited to the embodiments described above, but encompasses any and all embodiments within the scope of the following claims.

I claim:

1. A liner for concrete forms, comprising:

a plastic matrix of thin, elongate liner elements arranged in an openwork pattern, each of the liner elements having an embedding surface and an outer surface generally opposite the embedding surface, wherein each of the liner elements has a substantially flat outer surface and geometrically-shaped embedding surface, thereby simulating the geometrical cross-sectional shape of a mortar groove or joint in a masonry wall; and a plurality of separable tabs located substantially throughout the entire matrix and extending outwardly from the peripheral surface of the embedding surface of the liner elements, each of the tabs including a thin stem and an enlarged distal end, wherein the tabs are separable at the juncture of the stem and the embedding surface of the liner elements, thereby leaving only the stems showing in the concrete.

2. The liner for concrete forms according to claim 1, wherein the geometrical cross-sectional shape is a substantially semicircular cross section defining an arcuate embedding surface.

3. The liner for concrete forms according to claim 1, wherein the flat outer surface of the liner includes double-adhesive tape.

4. The liner for concrete forms according to claim 1, further comprising:

a first edge liner element having a tongue edge disposed therealong; and a second edge liner element having a groove edge disposed therealong, the first edge liner mating with the second edge liner when multiple concrete panels are assembled laterally to one another.

5. The liner for concrete forms according to claim 1, further comprising upper and lower edge liner elements having a quarter round cross section, each of the upper edge elements mating with a corresponding one of the lower edge elements when multiple concrete panels are assembled vertically to one another.

6. A method of forming a simulated masonry panel using the apparatus of claim 1, comprising the steps of:

(a) placing the matrix into a concrete form;

(b) pouring concrete into the concrete form, thereby encapsulating the matrix in the concrete between the concrete and the concrete form, the matrix forming simulated mortar joints in the concrete;

(c) allowing the concrete to cure;

(d) removing the cured concrete and embedded matrix therein from the concrete form, thereby exposing the formed surface of the concrete;

(e) finishing the formed surface of the cured concrete on surfaces exposed by the matrix; and (f) removing the matrix from the cured concrete, thereby exposing the simulated mortar joints.

7. The method of forming a concrete panel according to claim 6, further including the steps of:

(a) attaching a first side of a double-sided adhesive tape to the outer surface of the liner elements; and (b) removably attaching the matrix in the concrete form by attaching a second side of the double-sided adhesive tape to the concrete form.

8. The method of forming a concrete panel according to claim 6, further including the steps of:

(a) encapsulating the tabs within the concrete when the concrete is poured over the matrix; and (b) separating the tabs from the embedding surface of the liner elements when the matrix is separated from the cured concrete, the tabs remaining encapsulated in the cured concrete after the matrix is removed therefrom.

9. The method of forming a concrete panel according to claim 6, wherein the step of finishing the surface of the cured concrete is performed prior to removing the matrix therefrom.

10. The method of forming a concrete panel according to claim 9, wherein the step of finishing the surface of the cured concrete comprises texturing the surface.

11. The method of forming a concrete panel according to claim 9, wherein the step of finishing the surface of the cured concrete comprises applying a coating to the surface.

* * * * *